US006324825B2

(12) United States Patent
Dinkelmann et al.

(10) Patent No.: US 6,324,825 B2
(45) Date of Patent: Dec. 4, 2001

(54) DRAFTING FRAME FOR A SPINNING MACHINE

(75) Inventors: Friedrich Dinkelmann, Rechberghausen; Andreas Olbrich, Kirchheim; Detlef Buschlüter, Birenbach; Angelika Stoll, Köngen; Rainer Löscher, Chemnitz, all of (DE)

(73) Assignee: Zinser Textilmaschinen GmbH, Ebersbach/Fils (DE)

( * ) Notice: Subject to any disclaimer, the term of this patent is extended or adjusted under 35 U.S.C. 154(b) by 0 days.

(21) Appl. No.: 09/801,322

(22) Filed: Mar. 7, 2001

(30) Foreign Application Priority Data

Mar. 8, 1920 (DE) ..... 100 11 242
Oct. 10, 2000 (DE) ..... 100 50 089

(51) Int. Cl.[7] ..... D01H 13/04

(52) U.S. Cl. ..... 57/315; 57/264; 19/150; 19/246

(58) Field of Search ..... 19/150, 236–250, 19/252, 263, 286–288, 304–308; 57/264, 304, 315, 328, 333

(56) References Cited

U.S. PATENT DOCUMENTS 4,953,349 * 9/1990 Fehrer ..... 57/315
5,085,046 * 2/1992 Fehrer ..... 57/315
5,243,813 * 9/1993 Stahlecker ..... 57/328
6,108,873 8/2000 Barauke ..... 19/236
6,131,382 * 10/2000 Dinklemann et al. ..... 57/315
6,131,383 * 10/2000 Dinklemann et al. ..... 57/315
6,134,872 * 10/2000 Olbrich ..... 57/264
6,170,126 * 1/2001 Stahlecker ..... 19/246
6,189,308 * 2/2001 Dinkelmann et al. ..... 57/315

FOREIGN PATENT DOCUMENTS 197 08 410 9/1998 (DE) .
198 46 268 10/1999 (DE) .

* cited by examiner

*Primary Examiner*—John J. Calvert
*Assistant Examiner*—Gary L. Welch
(74) *Attorney, Agent, or Firm*—Herbert Dubno

(57) ABSTRACT

A drafting frame for a spinning machine, especially a ring-spinning machine can be readily retrofitted with a compaction device adjacent the last pair of drafting rollers if the condensing zone is defined between a clamping location formed by the nip of the last roller pair and a clamping location formed by a number of elements of the compacting device against the upper roller of the last roller pair.

18 Claims, 5 Drawing Sheets

DRAFTING FRAME FOR A SPINNING MACHINE

FIELD OF THE INVENTION

Our present invention relates to a drafting frame for a spinning machine and, more particularly for a drafting frame of the type in which the output roller pair of the drafting frame is followed by a compaction zone in which, utilizing suction, a condensing of the drafted sliver is carried out.

BACKGROUND OF THE INVENTION

A drafting frame for a spinning machine is described, for example, in German patent document DE 197 08 410 A1 and has, at the output side of the drafting frame, a fiber bundling, compaction or condensing zone. Between the output roller pair of the drafting frame and a further feed roller pair delivering the drafted and condensed sliver to the spinning machine, a fiber bundling zone is provided. The fiber bundling zone in this system has a suction shoe over which a perforated belt is looped. The suction shoe is subjected to suction from a suction pump and the perforated belt has a row of perforations to which the sliver is exposed to the suction as the belt passes across the shoe and the sliver lies along the belt. The suction draws any outwardly-projecting fibers into and along the sliver to produce the compaction or condensation effect. The suction through the perforations results in an air flow transverse to the displacement of the sliver to direct the fibers inwardly.

Because of the need for the feed roller pair, a retrofitting of the drafting frame of a conventional spinning machine with a compaction unit is expensive and often impractical.

Another compaction system has been described in German patent document DE 198 46 268 A1, corresponding to U.S. Pat. No. 6,108,873. In this construction the drafting frame is provided at its outlet side with a clamping roller which is driven by one of the output rollers of the drafting frame. The latter output drafting roller and the clamping roller may be coupled together by a transmission unit, for example a gear set or a pulley system. This arrangement has the drawback that the transmission elements are sensitive to contamination and fibers or the like can wind up or accumulate therein. Furthermore, any transmission elements of that type may generate lint or particulates which may be disadvantageous.

OBJECTS OF THE INVENTION

It is the principal object of the present invention to provide a relatively simple, reliable and efficient compaction unit for association with a drafting frame for a spinning machine whereby drawbacks of earlier systems are avoided.

Another object of this invention is to provide a drafting frame which can have the advantages of sliver compaction or condensation and whereby the provision of the sliver compactor by retrofitting a drafting frame without such a compactor is facilitated.

Yet another object of this invention is to provide an improved drafting frame for a spinning machine which is free from drawbacks associated with superfluous transmission elements in the region of the drafting frame.

SUMMARY OF THE INVENTION

These objects and others which will become apparent hereinafter are attained, in accordance with the invention, in a drafting frame for a spinning machine which comprises:

a plurality of roller pairs disposed in succession and operating at successively higher peripheral speeds for drafting a sliver, the plurality of roller pairs including an output roller pair delivering a drafted sliver; and a condensing zone downstream of the roller pairs for receiving the drafted sliver and defined between an upstream first clamping location formed by a nip of the output roller pair engaging the drafted sliver and a downstream second clamping location engaging the sliver between a pressing element of a pneumatic sliver compactor and a peripheral portion of a roller of the output roller pair, the pneumatic sliver compactor comprising a suction opening and a transport member having a row of perforations passing across the suction opening and over the pressing element for drawing sliver fibers of the drafted sliver inwardly to condense the drafted sliver upstream of the second clamping location.

According to the invention, therefore, the second clamping location utilizes a peripheral portion of one of the output rollers of the drafting frame, i.e. one of the rollers of the output pair, and a pressing element of the compaction unit which bears thereagainst. As a consequence the pneumatic compactor, which can be comprised of a suction shoe and a perforated transport medium, usually a belt, can be made substantially more compact than the compactor of conventional units. Because the compactor of the invention occupies less space, the transport element for the sliver to be compacted can be driven directly by the output rollers of the drafting frame.

According to a feature of the invention, the second clamping location can be formed by a peripheral portion of the upper roller of the output roller pair.

In a drafting frame in which the transport element is looped over two rollers (routing rollers or deflecting rollers), one of the rollers is constituted as a pressing roller and serves as the pressing element for the second clamping location. The pressing roller can be biased by at least one spring against the output roller forming the clamping location. The transport element is thus pressed against the output roller by the spring-loaded routing roller and is driven by the output roller. The routing roller and the output roller forming the clamping location thus so engage the drafted and compacted sliver between them that passage of the twist imparted to the sliver in the spinning machine back into the compaction or condensing zone is precluded.

With the construction of the invention, the fiber bundling zone is defined, on the one hand, between the first clamping location formed by the output roller pair and, on the other hand, by the second clamping location formed between the pressing element on the upper roller of the output roller pair. To facilitate service of the drafting frame, the routing rollers can be paired in a manner similar to the pairing of the upper rollers of the drafting frame. Customarily each weighting arm of the drafting frame carries pairs of the upper rollers which are lowered onto the respective slivers as the latter rest upon the lower rollers.

Alternatively the transport element can loop around the suction shoe and the suction shoe can then form the pressing element defining the second clamping location. Routing rollers can then be eliminated entirely since the suction shoe can be surrounded by the transport element which can be formed as a perforated belt and can have a double function in that it forms the second clamping location as well as serving to carry away the drafted and condensed sliver.

According to another feature of the invention, the pressing element can have a sieve roller provided with a shielding element. The shielding element can limit the suction at the interior of the sieve roller to a portion of the periphery thereof so as to generate the condensing suction and draw air inwardly toward the sliver. The shield, in this case, can be located within the sieve roller.

According to another feature of the invention, the pressing element can be provided with a recess and a hollow shaft having a stationary shielding element. The hollow shaft can be formed with the recess and indeed a plurality of recesses distributed around the circumference of the hollow shaft. The hollow shaft has at least one circumferential groove in which the shielding element can be received. Outwardly of the region of the groove, a perforated transport element, e.g. a belt, can be guided on the hollow shaft.

In embodiments of the invention in which a roller rotates to deliver the sliver to the spinning frame, this roller can be driven by one of the output rollers in a manner analogous to the supply roller of prior art systems. Depending upon the material of the sliver, a compacting spinning may be desirable with so-called oversupply or so-called undersupply of the sliver. For example in the spinning of fibers which are textured and have a crimped texture, the supply speed may be higher than the extraction speed of the sliver from the drafting frame. Conversely with other fibers, a reduced supply tension maybe desirable. In that case, the extraction speed may be higher than the speed with which the drafted and condensed sliver is supplied to the spinning frame. In the system of the invention the pressing element can be driven directly by the upper roller of the output roller pair of the drafting frame, but with a different ratio between the driving upper roller of the output roller pair and the driven pressing element.

According to a further feature of the invention, the pressing element can have shoulders at its ends which bear against the periphery of the upper roller or, alternatively, the upper roller may have shoulders which bear against the pressing roller or element and thus impart different peripheral speeds to the pressing element as required for the oversupply and undersupply.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
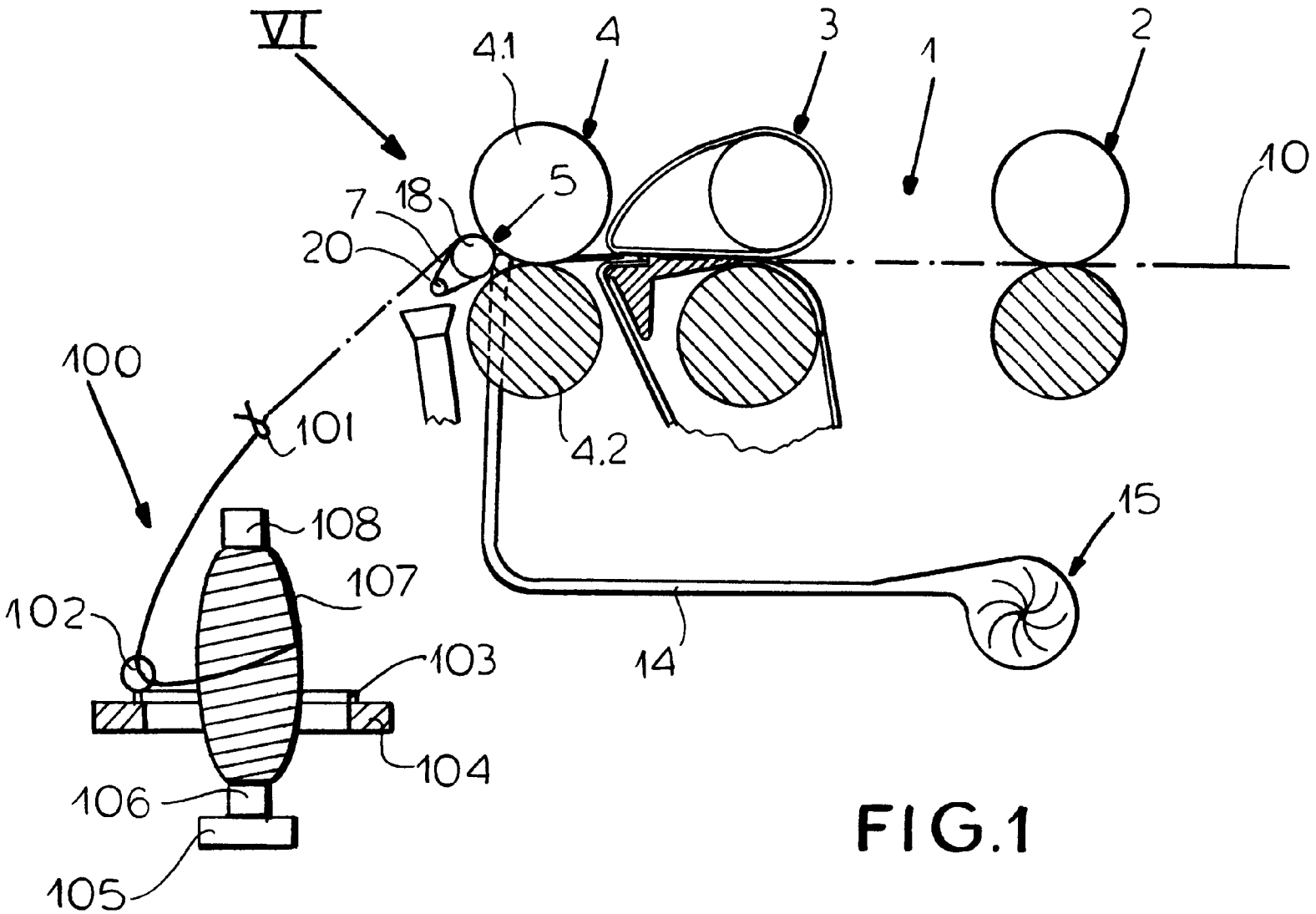
FIG. 1 is a diagrammatic cross sectional view of a drafting frame, showing the spinning frame of the spinning machine only diagrammatically and representing one of the sliver drafting stations in side view.

FIG. 1 shows a drafting frame 1 for a spinning machine 100 which has a thread guide eye 101, a traveler 102 travels by the compacted drafted sliver, a traveler ring 103, a ring rail 104 which can be raised and lowered, a spindle rail 105 carrying the spindles 106 and capable of winding a roving bobbin 107 on a bobbin tube 108 fitted onto the spindle. The drafting frame is capable of drafting the sliver 10 and condensing or compacting it in the manner described. The drafting frame can have a first roller pair 2 and a second roller pair 3 which are driven with the progressively higher speeds. At the downstream end of the drafting frame an output roller pair 4 with an upper roller 4.1 and a lower roller 4.2 are provided. The main drafting field is found between the second roller pair 3 and the output roller pair 4.

Adjacent the output roller pair 4 is a fiber bundling zone 5, also referred to here as a compaction or condensing zone, provided with a pneumatic compaction unit 6 (FIG. 2) which includes a suction shoe 12 about which a perforated transport element, e.g. a transport belt, is looped. The suction shoe 12 is connected via a pipe 14 to a suction pump 15 forming a reduced pressure source.

Figure 2:
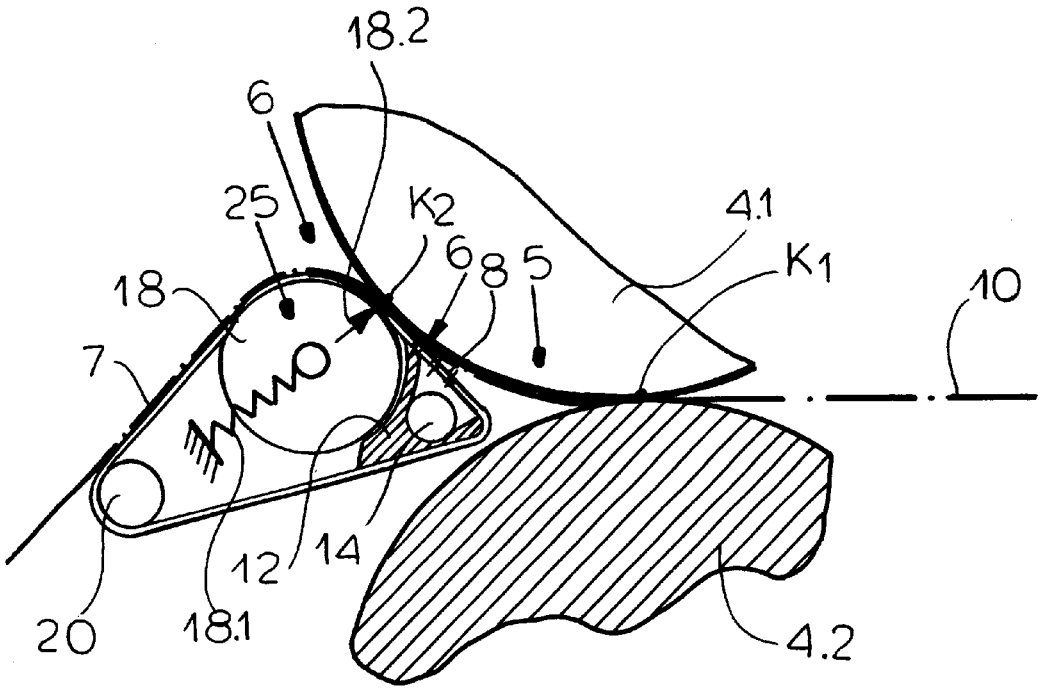
FIG. 2 is an enlarged sectional view showing the fiber bundling zone of FIG. 1.

As can especially be seen from FIG. 2, the fiber bundling zone 5 is bounded by two clamping locations $K_1$ and $K_2$. The first clamping location $K_1$ is defined by the nip between two rollers 4.1 and 4.2 of the output roller pair 4.

According to the invention, the second clamping location $K_2$ is formed between a peripheral portion of one of the rollers 4.1 and 4.2 of the output roller pair and the pressing element 25 of the compaction unit 6 which bears thereagainst. In the embodiment of FIGS. 1 and 2, the peripheral portion is part of the upper roller 4.1 of the output roller pair 4 and the routing roller 18 which is biased toward the roller pair 4, constituting the pressing element 25 for the second clamping location $K_2$.

In this embodiment it will be apparent that the belt 7 with its row of perforations 8 is looped around the routing rollers 18 and 20.

From FIGS. 1 and 2, therefore, it will be apparent that the fiber bundling zone 5 is defined between the two clamping locations $K_1$ and $K_2$, the former being formed by the nip of the output rollers 4.1 and 4.2 while the latter is formed by the surface of the upper roller 4.1 and the pressing element bearing thereof and constituted by the routing roller 18 in FIG. 2. It is this second clamping location $K_2$ which prevents the twist arising at the respective spindle station of the spinning frame 100 from advancing into the fiber bundling zone past the location $K_2$. The routing roller 18 directly adjacent the suction shoe 12 and is biased by at least the spring represented at 18.1 in the direction of the arrow 18.2 against the roller 4.1 to form that clamping location $K_2$.

Figure 8:
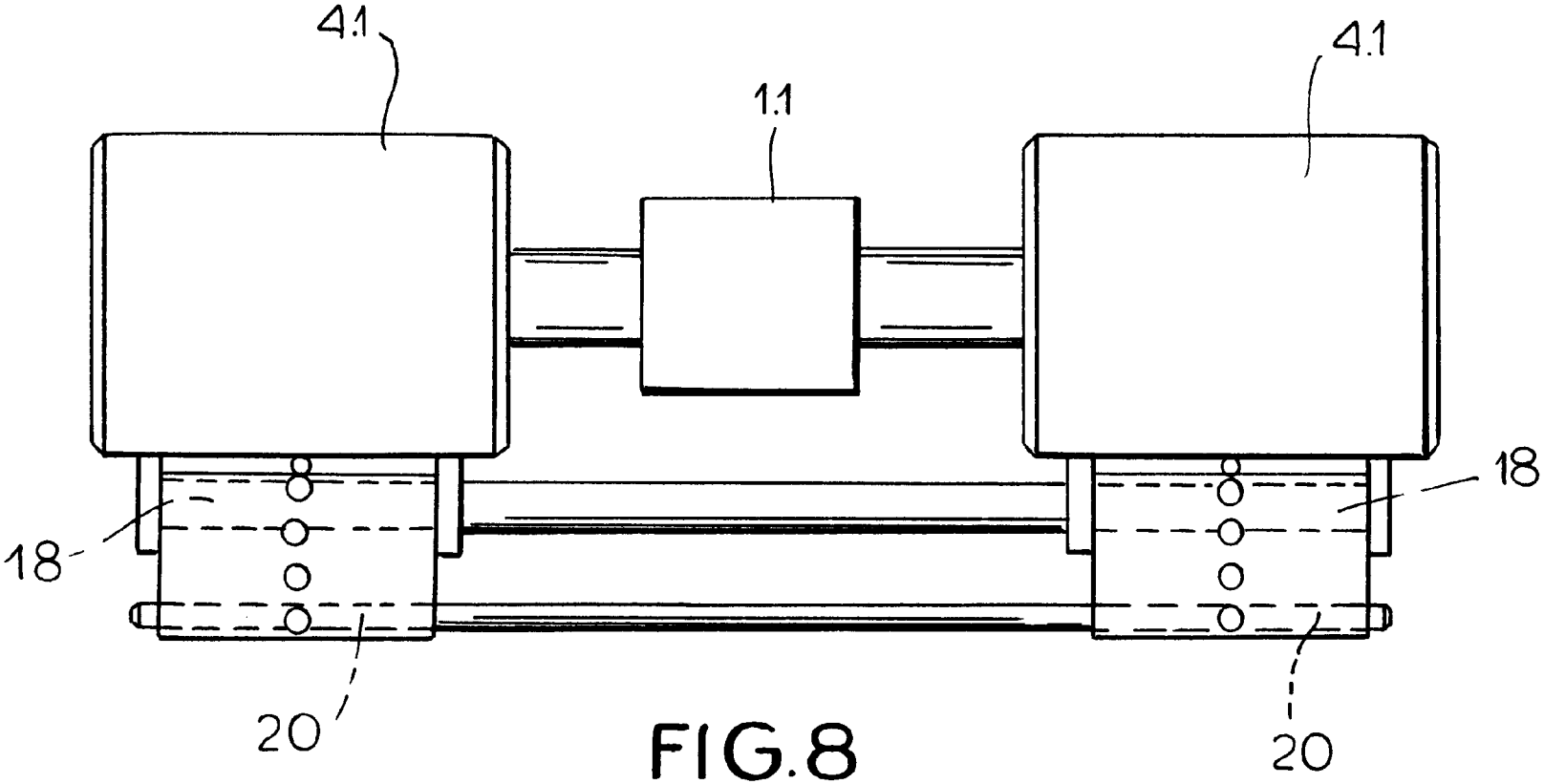
FIG. 8 is a front view of a portion of the drafting frame showing twin rollers as the upper rollers of the output pair.

To facilitate servicing of the drafting frame, the routing rollers 18 and 20 can be twisted or paired like the upper rollers 4.1 as shown in FIG. 8. The weighting arm of the drafting frame on which the roller pairs 4.1 are mounted has been shown at 1.1 in FIG. 8.

Figure 3:
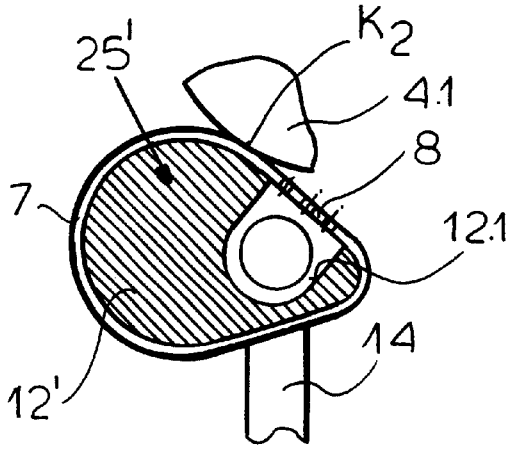
FIG. 3 is a cross sectional view showing another embodiment of the invention from the side.

FIG. 3 illustrates another embodiment of the invention in which no routing rollers are provided but the suction shoe 12' is surrounded by the transport element 7 which is in the form of a belt looped around the suction shoe 12. The opening 12.1 of the suction shoe across which the perforations 8 in the belt 7 pass, is connected by the pipe 14 with the suction pump or blower 15. In this case the suction shoe 12' of the pressing element 25' bears against the roller 4.1 to define the second location $K_2$ as has been described.

Figure 4:
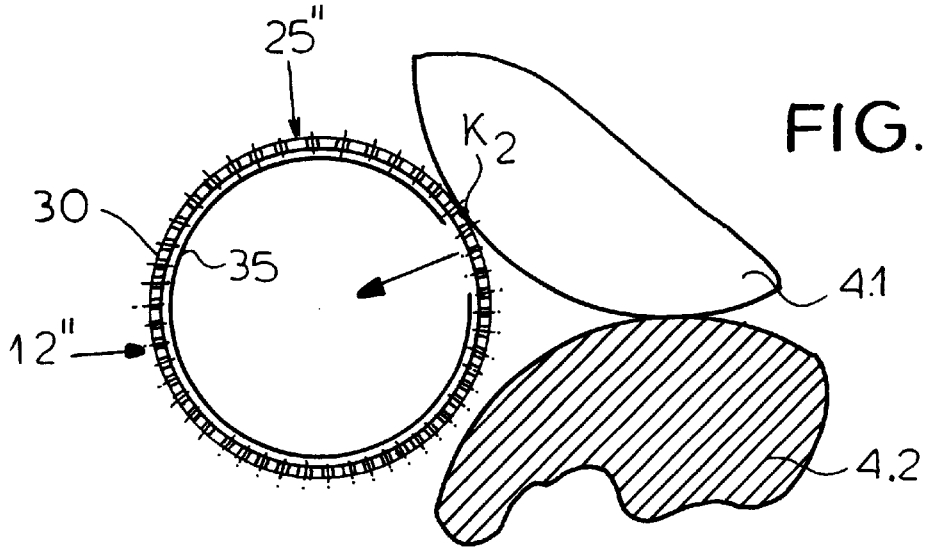
FIGS. 4 and 5 are further sectional views showing suction units according to the invention from the side.
Figure 5:
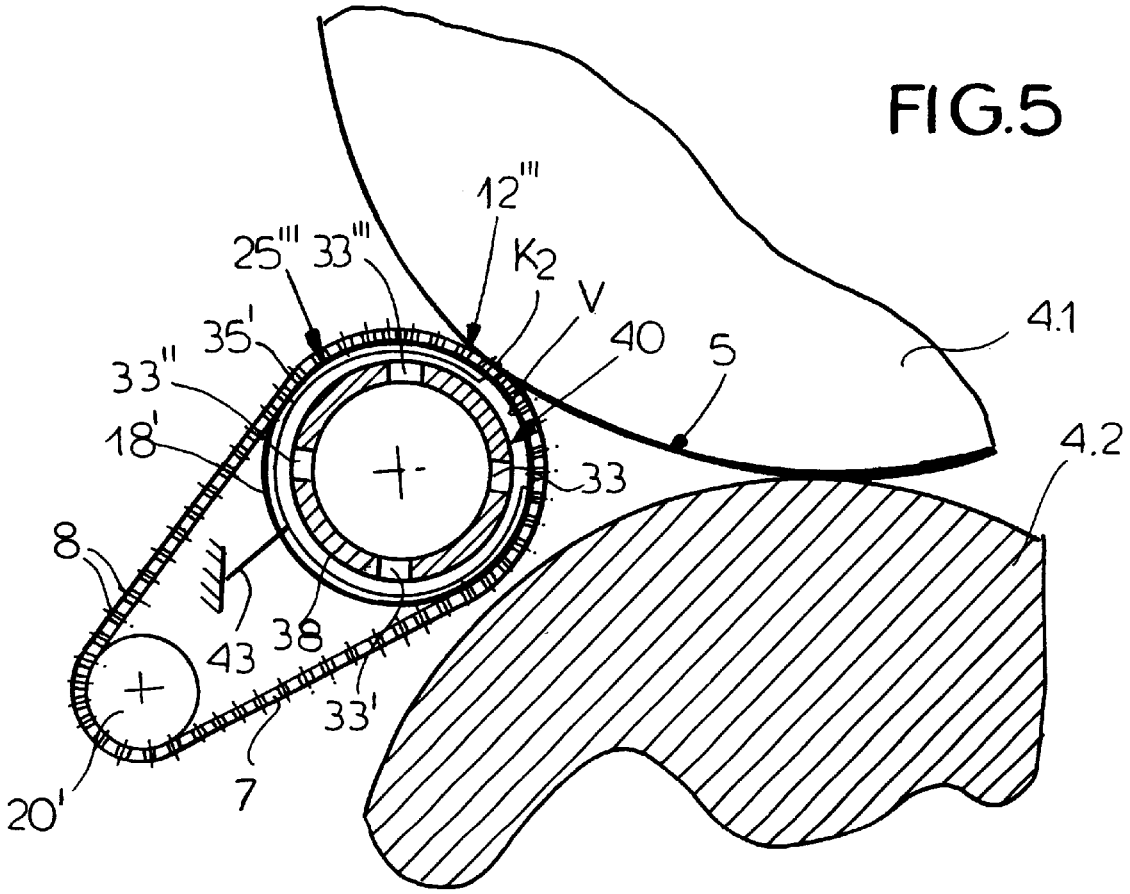

FIG. 4 shows another approach in which the pressing element 25" is a sieve roller 30 provided with a shield 35 which forms the suction shoe 12". The shield 35 confines the suction to the compaction zone V which extends over a portion of the periphery of the sieve roller 30. Here the shield 35 is located within the sieve roller 30. FIG. 5 illustrates an embodiment in which the pressing element 25''' is formed by a hollow shaft 38 having at least one opening 33 and preferably a plurality of openings 33, 33', 33", 33''' distributed about the periphery of the hollow shaft. A stationary shield 35' forms the suction shoe 12'''. The hollow shaft 38 has at least one circumferential groove 40 in which the shield 35' is received. The shield is held by a mounting represented only diagrammatically at 43 and is stationary. The hollow shaft 38 forms a routing roller 18' around which the belt 7 is looped, a second routing roller being seen at 20'. Outside the region of the groove 40, the belt 7 rides on the outer periphery of the hollow shaft 38.

The shield 35' which is stationary, ensures that suction will be applied only in the region V of the perforated transport belt 7 at the compaction zone. In the embodiment of FIG. 4, the sieve roller 30 participates in forming the second clamping location while in the embodiment of FIG. 5 the hollow shaft 38 takes part in forming the clamping location $K_2$, both together with the upper roller 4.1.

Figure 6:
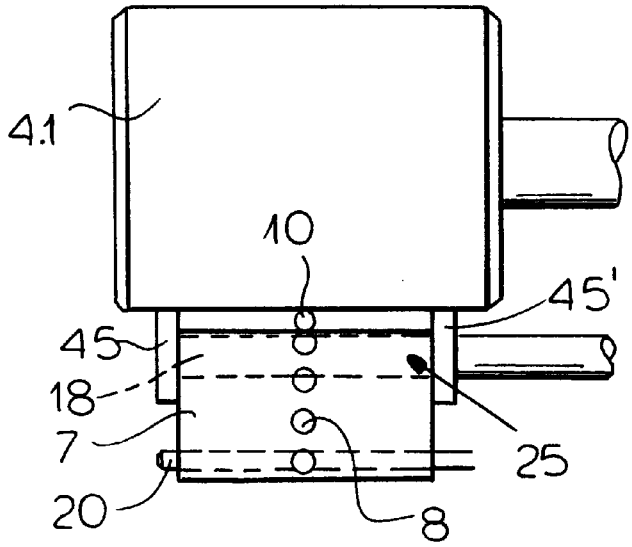
FIGS. 6 and 7 are front views of respective upper rollers of the output roller pair of drafting frames showing the pressing elements driven thereby.
Figure 7:
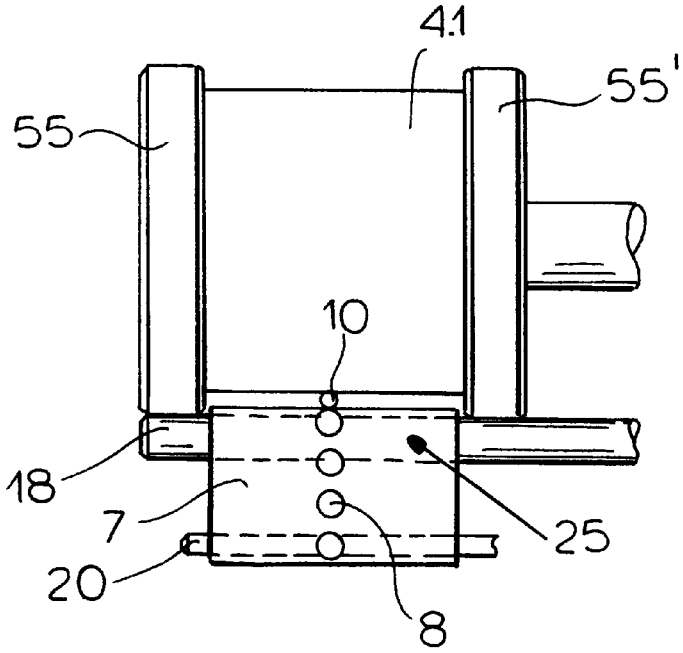

While in FIGS. 2–4, the pressure element 25 or 25" moves at the same peripheral speed as the upper roller 4.1, in FIG. 6 and 7, which correspond to a view in the direction of the arrow VI in FIG. 1, the peripheral speed of the belt may be less than or greater than the peripheral speed of the roller 4.1. In that case, corresponding to an oversupply or undersupply of the sliver, the pressing element 25 has shoulders 45 and 45' which frictionally engage the roller 4.1 and are driven thereby. The peripheral speed ratio between the roller 18 and the roller 4.1 is thereby reduced.

In FIG. 7 the shoulders 55, 55' are provided on the roller 4.1 and the peripheral speed of the roller 18 is increased relative to the peripheral speed of the roller 4.1. As a consequence, especially for fibers which have a crinkled texture, a reduced tension is applied during compaction. It has been found in practice that an oversupply or undersupply between 2% and 10% is preferred and any range of stepping of the diameters of the shoulders is possible from several millimeters to less than 1 mm.

In an especially advantageous embodiment of the invention, the diameter of the routing roller 18, i.e. the feed roller, is so selected that the shoulder has a height so that for a gap of about 1 mm, the desired ratio of peripheral speeds between output roller 4.1 and the routing roller 18 is achieved. That ratio should be obtained without the additional drive rollers or transmission members. FIG. 6 illustrates the situation in which there is an oversupply of the roving to the spinning frame while FIG. 7 illustrates an undersupply. In FIG. 7 the routing roller 18 is driven with a higher peripheral speed than the roller 4.1.

The device of FIGS. 1–5 can easily be retrofitted to existing ring spinning machines at low cost. Additional transmission or drive elements are unnecessary and well-defined clamping locations $K_1$ and $K_2$ define the bundling zone.

We claim:

1. A drafting frame for a spinning machine, comprising:

a plurality of roller pairs disposed in succession and operating at successively higher peripheral speeds for drafting a sliver, said plurality of roller pairs including an output roller pair delivering a drafted sliver; and a condensing zone downstream of said roller pairs for receiving the drafted sliver and defined between an upstream first clamping location formed by a nip of said output roller pair engaging the drafted sliver and a downstream second clamping location engaging said sliver between a pressing element of a pneumatic sliver compactor and a peripheral portion of a roller of said output roller pair, said pneumatic sliver compactor comprising a suction opening and a transport member having a row of perforations passing across said suction opening and over said pressing element for drawing sliver fibers of the drafted sliver inwardly to condense the drafted sliver upstream of said second clamping location.

2. The drafting frame defined in claim 1 wherein said opening is formed in a suction shoe and said transport member is looped around said suction shoe, said suction shoe forming said pressing element.

3. The drafting frame defined in claim 1 wherein said pressing element is a sieve roller provided with a shield confining suction to a limited region of said sieve roller.

4. The drafting frame defined in claim 3 wherein said shield confines the suction only to said condensing zone.

5. The drafting frame defined in claim 3 wherein said shield is disposed within said sieve roller.

6. The drafting frame defined in claim 1 wherein said pressing element is driven by contact directly by the roller of the output roller pair engaged thereby.

7. A drafting frame for a spinning machine, comprising:

a plurality of roller pairs disposed in succession and operating at successively higher peripheral speeds for drafting a sliver, said plurality of roller pairs including an output roller pair delivering a drafted sliver; and a condensing zone downstream of said roller pairs for receiving the drafted sliver and defined between an upstream first clamping location formed by a nip of said output roller pair engaging the drafted sliver and a downstream second clamping location engaging said sliver between a pressing element of a pneumatic sliver compactor and a peripheral portion of a roller of said output roller pair, said pneumatic sliver compactor comprising a suction opening and a transport member having a row of perforations passing across said suction opening and over said pressing element for drawing sliver fibers of the drafted sliver inwardly to condense the drafted sliver upstream of said second clamping location, the peripheral portion being a peripheral portion of an upper roller of said output roller pair.

8. A drafting frame for a spinning machine, comprising:

a plurality of roller pairs disposed in succession and operating at successively higher peripheral speeds for drafting a sliver, said plurality of roller pairs including an output roller pair delivering a drafted sliver; and a condensing zone downstream of said roller pairs for receiving the drafted sliver and defined between an upstream first clamping location formed by a nip of said output roller pair engaging the drafted sliver and a downstream second clamping location engaging said sliver between a pressing element of a pneumatic sliver compactor and a peripheral portion of a roller of said output roller pair, said pneumatic sliver compactor comprising a suction opening and a transport member having a row of perforations passing across said suction opening and over said pressing element for drawing sliver fibers of the drafted sliver inwardly to condense the drafted sliver upstream of said second clamping location, transport member being guided around two routing rollers, one of said routing rollers being biased against said peripheral portion and forming said pressing element.

9. The drafting frame defined in claim 8, further comprising at least one spring biasing said one of said routing rollers against said peripheral portion.

10. The drafting frame defined in claim 8 wherein said routing rollers are paired for the drafting of two slivers.

11. The drafting frame defined in claim 8 wherein said pressing element is a hollow shaft formed with at least one opening and a fixed shield.

12. The drafting frame defined in claim 11 wherein said hollow shaft is formed with a plurality of openings distributed over a circumference of the hollow shaft.

13. The drafting frame defined in claim 11 wherein said hollow shaft has at least one circumferential groove receiving said shield.

14. The drafting frame defined in claim 13 wherein said member is guided along a periphery of the hollow shaft outside a region of said groove.

15. The drafting frame defined in claim 14 wherein said member is a belt guided over the hollow shaft forming one of said routing rollers and the other of said routing rollers.

16. The drafting frame defined in claim 15 wherein the belt is driven at a different peripheral speed from that of the roller of the output roller pair engaged by said pressing element.

17. The drafting frame defined in claim 16 wherein said pressing element has shoulders at opposite ends thereof bearing against a circumference of the roller of the output roller pair engaged thereby and flanking said member.

18. The drafting frame defined in claim 16 wherein said roller of the output roller pair engaged by said pressing element has shoulders against which said pressing element bears and flanking said member.

* * * * *

UNITED STATES PATENT AND TRADEMARK OFFICE

CERTIFICATE OF CORRECTION

PATENT NO. : 6,324,825 B1
DATED : December 4, 2001
INVENTOR(S) : Friedrich Dinkelmann et al.

It is certified that error appears in the above-identified patent and that said Letters Patent is hereby corrected as shown below:

Title page,
Item [30], Foreign Application Priority Data, "Mar. 8, 1920" to read -- Mar. 8, 2000 --

Signed and Sealed this

Ninth Day of April, 2002

*Attest:*

*Attesting Officer*

JAMES E. ROGAN
*Director of the United States Patent and Trademark Office*